US006716121B1

(12) United States Patent
Brown

(10) Patent No.: US 6,716,121 B1
(45) Date of Patent: Apr. 6, 2004

(54) HEAVY HITTER BATTING PRACTICE AID

(76) Inventor: Kent F. Brown, 766 E. Plantation Dr., Titusville, FL (US) 32780

( * ) Notice: Subject to any disclaimer, the term of this patent is extended or adjusted under 35 U.S.C. 154(b) by 0 days.

(21) Appl. No.: 10/408,706

(22) Filed: Apr. 7, 2003

(51) Int. Cl.[7] ..... A63B 69/40
(52) U.S. Cl. ..... 473/451
(58) Field of Search ..... 473/423, 453, 473/451, 417, 441; 446/351, 486

(56) References Cited

U.S. PATENT DOCUMENTS 1,623,119 A * 4/1927 Kearney ..... 473/391
4,097,044 A * 6/1978 Miniere ..... 473/451
4,533,138 A * 8/1985 Rodriguez et al. ..... 473/417
4,655,452 A * 4/1987 Huerstel ..... 473/453
4,836,533 A * 6/1989 Dong ..... 482/83
5,226,645 A * 7/1993 Stewart ..... 473/453
5,503,391 A * 4/1996 Stelly ..... 473/451
5,738,599 A * 4/1998 Malwitz ..... 473/423
6,077,204 A * 6/2000 Dickinson, Jr. ..... 482/83
6,454,670 B1 * 9/2002 Beers ..... 473/451

* cited by examiner

*Primary Examiner*—Paul T. Sewell
*Assistant Examiner*—Nini F. Legesse
(74) *Attorney, Agent, or Firm*—Donald W. Meeker

(57) ABSTRACT

A baseball-training device that improves the accuracy and power of a batter's swing. The device comprises a wheeled base, telescoping vertical stand, and an automotive tire. The wheeled base provides mobility for the device. The telescoping vertical stand has a top arched portion that supports the automotive tire. The telescoping vertical stand also comprises a hinge means and a tensioning means. The tire is capable of being hit by a baseball bat on a marked side tread portion of the tire so that the motion of the baseball bat is resisted by a natural resilience of the tire and the tensioning means. The device is easy to manufacture and relatively inexpensive, thereby making it available to all baseball or softball player enthusiasts. The device is of a durable, long life construction and able to sustain repeated attempts by practicing hitters.

15 Claims, 4 Drawing Sheets

HEAVY HITTER BATTING PRACTICE AID

BACKGROUND OF THE INVENTION

1. Field of the Invention

The present invention relates generally to a baseball training apparatus, and more particularly, to such a device that can be used to improve the power and hitting ability of a batter.

2. Description of the Prior Art

A desirable characteristic of baseball players is that they possess acceptable hitting skills. Two of the most important contributors to good hitting are power and the ability to swing so as to have the bat meet the ball. While practice, weight training, and the use of existing training devices have proved somewhat helpful, there is a perceived need for a baseball training device which can simultaneously increase the power of a swing, while at the same time developing a swing which will result in the batter more effectively gaining contact with the ball.

The most desirable swing is a level swing. From that initial type of swing, a batter may proceed to strike the lower side of a ball to induce a fly ball or strike the topside of the ball to induce a grounder. In either event, it is important for the batter to have the bat make good contact with the ball. Some players try as they might, have extreme difficulty with producing a level swing. Instead, the player is said to be reaching upwardly or downwardly with the bat. In fact, in some cases a player may actually prefer to hit in this non-level manner under the belief that such a hitting style is more powerful or effective.

Other prior art hitting practice devices generally do not improve the hitting power of the batter as well as hitting form and are sometimes expensive devices.

Prior art U.S. Pat. No. 6,454,670, issued Sep. 24, 2002 to Beers, provides a swing-practicing device that trains a hitter, such as a baseball batter, to improve the accuracy and power of his swing. A target is coupled to the terminal end of a target support, the target accepting swing impacts without separating from the target support. The target support extends from a base having a rounded bottom surface, the curves of the rounded surface in rotational engagement with the ground. Swing impacts at the target cause the apparatus to rotate from an upright position to a more horizontal position and then return to the upright position to accept repeated swing impacts. The device can include an inflatable air bladder within the target and target support, and can include an adjustable weight for its base. The device can also include an adjusting mechanism to adjust the vertical height of the target.

Prior art U.S. Pat. No. 6,238,308, issued May 29, 2001 to Sanchez, shows a hitting trainer that has a slanted surface mounted on a stand, and which the player will hit with a bat in order to develop strength and quickness. mounting bracket secured thereon. A rubber tire has an opening therethrough. The rubber tire receives the vertical post through the opening and is secured to the mounting bracket of the vertical post. A series of baseballs are painted on the outer surface of one of the two sidewalls.

Prior art U.S. Pat. No. 4,185,821, issued Jan. 29, 1980 to Piccini, describes a batting practice device that is a tubular elastomeric cylinder closed at both ends and has a mounting tube down the center with a bore capable of receiving a rope or other tension suspension member. A valve is provided for filling the interior portion of the closed end cylinder to a depth of 30% to 70% of the volume with a fluid such as water. The method contemplates providing a batter with such a structure, and repetitively swinging a bat against the subject device to simulate the resistance rebound effect of striking a ball.

Prior art U.S. Pat. No. 5,738,599, issued Apr. 14, 1998 to Malwitz, discloses a batting practice device that is attachable to any of various existing permanent fixtures. The device includes a mounting bracket attachable to the fixture, the bracket supporting a receiving tube. The tube has two opposing openings for interlockably receiving a rod with a portion extending from the bracket in a cantilevered horizontal fashion. A first metal support plate is transversely mounted on the rod portion extending from the bracket. A tire has a tread face and an inside wall. The tread face abuts the metal plate. A second metal support plate is located on the inside wall, aligned with the first plate. This configuration of plates sandwich and support the tire in place while being hit by a bat.

Prior art U.S. Pat. No. 4,097,044, issued Jun. 27, 1978 to Miniere, indicates a batting training device that is designed and constructed to have a movable target which is automatically positioned for batting practice after each blow delivered with a baseball bat.

Prior art U.S. Pat. No. 4,903,966, issued Feb. 27, 1990 to Liao, puts forth a device for batting and striking practice that has a base assembly to provide a firm support. The base assembly has a threaded hole for receiving a lower tube. A sleeve encompassing a set of packing rings and an intermediate tube constitute a height adjusting mechanism. The intermediate tube engages with a spring and a protective housing, which in turn engages with an upper tube. A variety of batting or striking bodies may be mounted on and engage with the spring.

Prior art U.S. Pat. No. 4,533,138, issued Aug. 6, 1985 to Rodriguez, Jr., concerns a multiple sport-training device which includes a stabilizing base and a vertical support. A vertically adjustable carriage is positioned on the vertical support. Connecting members extend from opposite sides of the carriage for reception of attachment members that are used for sports skills training purposes. The attachment members are rotatable around a horizontal axis so that their vertical attitude may be adjusted. Batting training devices, ball rebounders, catching nets, and batting tees comprise some of the attachment members. Additionally, the vertical support is foldable against the stabilizing base for easy storage and transport wheels are insertable into one of the connecting members to allow easy movement of the device when tilted on its side.

Prior art U.S. Pat. No. 4,123,053, issued Nov. 31, 1978 to Piccini, illustrates a method of practicing batting that includes providing an open-ended cylinder formed of an elastomeric material. The method includes swinging the cylinder from a support above the cylinder by using at least three support members symmetrically spaced and attached atop the cylinder at one end and attached to the support on the other end. The method further includes repetitively swinging a bat against a strike area on the cylinder.

Prior art U.S. Pat. No. 4,093,217, issued Jun. 6, 1978 to Piccini, is for a batting practice device that has an open-ended cylinder of reinforced rubber-like material of at least two plys and weighing at least ten pounds per foot. The cylinders being suspended by a sling of not less than three cables, terminating in a loop at an upper end portion for tying to an overhead support. The loop at the top is formed by bending the cables into an eye shape, and clamping the same. The cylinder is supported by means of apertures near its upper end, the lower end of the sling being secured therein and clamped in place.

Prior art U.S. Pat. No. 5,226,645, issued Jul. 13, 1993 to Stewart, provides a baseball-training device that has a base, a post extending upwardly from the base, an upper sleeve member secured to the post. The upper sleeve member has an upper barrier spaced a distance from the post, and a lower sleeve member secured to the post with a lower barrier spaced a distance from the post. A method of utilizing this baseball-training device is also disclosed.

Prior art U.S. Pat. No. 4,655,452, issued Apr. 7, 1987 to Huerstel, shows a batting practice device that includes an extensible frame, which is pivotally mounted to a base and oriented in a generally vertical position. An upper arm is pivotally mounted to the frame and extends in a direction generally perpendicular to the frame. An upper wheel is rotatably mounted to the upper arm for rotation about an axis generally perpendicular to the frame. A lower arm is rigidly mounted to the frame at a position below the upper arm and extends in a direction generally perpendicular to the frame. A lower wheel is rotatable mounted to the lower arm for rotation about an axis generally perpendicular to the frame. Outer circumference of the upper and lower wheels cooperate to form a nip through which a bat is swung during practice. An adjustable bias means urges the upper and lower wheels together. The frame may be raised and lowered to accommodate batters of differing heights and tilted to simulate different types of pitches.

Prior art U.S. Pat. No. 5,711,726, issued Jan. 27, 1998 to Powers, claims an apparatus for simulating actual batting practice. The device is used for training a batter to increase power, proper form and mechanics, and accuracy of the swing of the batter without the use of a pitched ball. The preferred embodiment utilizes a stand on which is mounted a batting target. The target comprises an upper resilient section fixed at its upper end to an upper support member and a lower resilient section fixed at its lower end to a lower resilient support member with the upper and lower resilient sections overlapping at their opposite free ends. A force sensing circuit is located within the batting target. A photoelectric velocity and angle detecting circuit measures the velocity and angle of the bat. Force, velocity and angle circuits are electrically connected to a processer. Also, a visual readout display is electrically connected to the processor for providing visual feedback of force, velocity and angle of the swing to the batter. When the batter strikes the lower resilient section, the force of the impact bends the upper and lower resilient sections. If the force of the swing of the bat is sufficient, the bat passes through the upper and lower resilient sections allowing the batter to complete a full swing. The resilient members return to the original position after the swing of the batter so as to be ready for the batter to swing the bat at the batting target again.

Prior art U.S. Pat. No. 3,386,733, issued Jun. 4, 1968 to Russo, describes a batting practice device or the like that comprises a frame defining a vertical clearance area. The vertical clearance area includes an impact simulator means in the form of downwardly and upwardly directed resilient target members. The target members yeildably resist passage of the bat through the target area. The device realistically simulates the impact experienced by a batter when striking a pitched ball.

It is thus apparent that the need exists for a baseball training device or the like which improves the accuracy of a batter's swing in addition to building a more powerful swing. There is also a need for a batting practice device that is easy to manufacture and relatively inexpensive, thereby making it available to young players as well as older avid baseball and softball player enthusiast. The device must be of a durable construction and able to sustain repeated attemps by practicing hitters. The device, therefore, must not only be durable but be of a long life construction that can take the hard abuse that the a training and learning baseball player may inflict on the batting practice device.

SUMMARY OF THE INVENTION

An object of the present invention is to provide a baseball hitting practice device for improving power as well as technique in hitting a baseball.

Another object of the present invention is to provide a baseball hitting practice device that is easy to manufacture and relatively inexpensive.

One more object of the present invention is to provide a baseball hitting practice device that is of durable, long-life construction, thereby being able to sustain repetitive hits.

An additional object of the present invention is to provide a baseball hitting practice device that has a wheeled base, thereby making it portable.

A contributory object of the present invention is to provide a locking means for the wheeled means thereby making the batting hitting practice device stationary during use.

A further object of the present invention is to provide a telescoping means thereby allowing the batting hitting practice device to be height adjustable.

An added object of the present invention is to provide a tension means for returning the vertical post to an upright position after being struck.

An ancillary object of the present invention is to provide an adjustable means for the tension means.

An ensuing object of the present invention is to provide a striking surface created from a tire that gives a natural resilience when being struck.

A further object of the present invention is to provide a marked area on the tire, divided into three levels that would help to improve a hitter's accuracy. perpendicularly, in vertical orientation, on the "leg" of the T-shape. By standing on the ground at the "leg" end of the horizontal support the hitter can stand closer to the striking area of the device. The horizontal support includes wheel means for moving the device. The wheel means are provided with locking mechanisms, which when engaged make the device stationary.

The vertical support has an inter-fitting vertical post, which is attached to the horizontal support by hinge means. The vertical support has a top arched portion that is preferably welded and rigidly connect to it. The top arched portion matches the interior radius of an automotive tire. A tension means is provided between the horizontal support and the vertical post to create a resistance to pivoting the vertical post relative to the horizontal support. The tension means comprises a spring means, wherein the spring means comprises a spring and a cable. The tension means further comprises a turnbuckle on the cable for adjusting the tension of the spring. The vertical support and the inter-fitting vertical post create a telescoping means thereby providing height adjustment capability. The telescoping means has a locking means that preferably comprises one hole in the vertical support, multiple holes in the vertical post and a conventional locking pin.

The device also comprises an automotive tire that has a natural resilience and a radius matching the radius of the arched portion of the vertical support. The tire is provided with an opening through a bottom tread portion of the tire. The opening is capable of receiving the vertical support and vertical post therethrough so that the tire is capable of being installed on the vertical support in a vertical orientation. The top interior of the tire would rest on the top arched portion of the vertical support and the vertical post would pass through the opening in the bottom tread portion of the tire. A securing means is provided for rigidly attaching the tire to the arched portion of the vertical support, thereby preventing rotation of the tire. The tire is capable of being hit by a baseball bat on a side tread portion of the tire so that the motion of the baseball bat is resisted by a natural resilience of the tire and the tension means between the vertical post and the horizontal support. When the vertical post pivots relative to the horizontal support in response to the force of the baseball bat, the tension means is capable of returning the vertical post to a vertical position. A target area on the tire, marked preferably in flourescent enamel paint, is divided into three levels that would help to improve a hitter's accuracy.

The device further comprises a covering for the tire formed from sheet material encompassing the tire and secured to the tire by a securing means. The securing means comprises a means of tying the covering around the tire. The sheet material cover comprises external visual indicia that simulate the appearance of a baseball. The visual indicia further comprise indicia selected from the group including a logo, a team name, a player name, a tournament name, a product name and an advertisement.

An advantage of the present invention is in improving the accuracy of a batter's swing.

Another advantage of the present invention is in building a more powerful swing.

An additional advantage of the present invention is that it is easy and relatively inexpensive to manufacture.

One more advantage of the present invention is in being height adjustable.

Yet another advantage of the present invention is that it is durable.

Still another advantage of the present invention is in being portable.

A different advantage of the present invention is in having a locking means to keep the whole device from rolling while being struck.

Another advantage of the present invention is that the device repositions itself after being struck.

A further advantage of the present invention is that it has a display means for team logos or adverisement.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
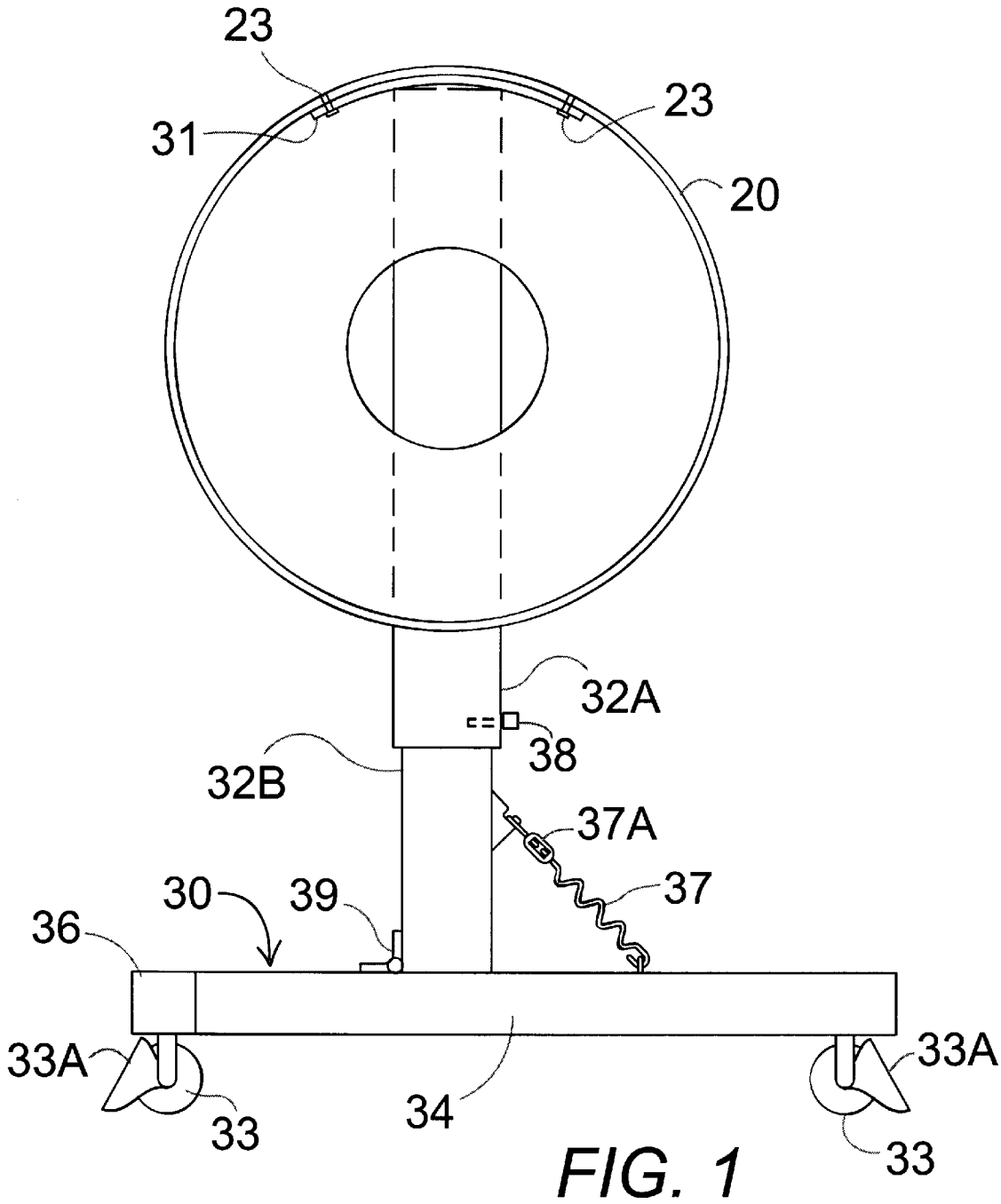
FIG. 1 is a side elevational view of the present invention showing the hitting tire mounted on the stand.

In FIG. 1–4, a baseball hitting practice device for improving power as well as technique in hitting a baseball is shown. The device comprises a stand 30 that has a horizontal support 36 capable of being positioned on the ground and a vertical support 32A. The horizontal support 36 is T-shaped in design, and has a vertical post 32B mounted perpendicularly, in vertical orientation, on the "leg" 34 of the T-shape. The horizontal support 36 comprises wheel means 33 for moving the device 30. The wheel means 33 are provided with locking mechanisms 33A to render the device 30 stationary when they are engaged.

The vertical support 32A has a vertical post 32B attached to the horizontal support 36 by a hinge means 39. The vertical support 32A has a top arched portion 31 rigidly connected to it, which matches the interior radius of an automotive tire 20. A tension means 37 is provided between the horizontal support 36 and the vertical post 32B to create a resistance to pivoting the vertical post 32B relative to the horizontal support 36. The tension means 37 comprises a spring means, wherein the spring means comprises a spring and a cable. The tension means further comprises a turnbuckle 37A on the cable for adjusting the tension of the spring. The vertical support 32A slides over the vertical post 32B creating a telescoping means thereby providing height adjustment capability. The telescoping means has a locking means that preferably comprises one hole 35 in the vertical support 32A, multiple holes 35 in the vertical post 32B and a conventional locking pin 38.

The device also coprises an automotive tire 20 that has a natural resilience and a radius matching a radius of the arched position 31 of the vertical support 32A. The tire 20 is provided with an opening through a bottom tread portion of the tire 20. The opening is capable of receiving the vertical support 32A and the vertical post 32B therethrough so that the tire 20 is capable of being installed on the vertical support 32A in a vertical orientation of the tire 20. In such s manner of installation the top interior of the tire 20 rests on the top arched portion 31 of the vertical support 32A and the vertical support post 32B passes through the opening in the bottom tread portion of the tire 20. A securing means such as bolts 23 (as shown in FIG. 1) or other attaching means is provided for rigidly attaching the tire 20 to the arched portion 31 of the vertical support 32A.

Figure 2:
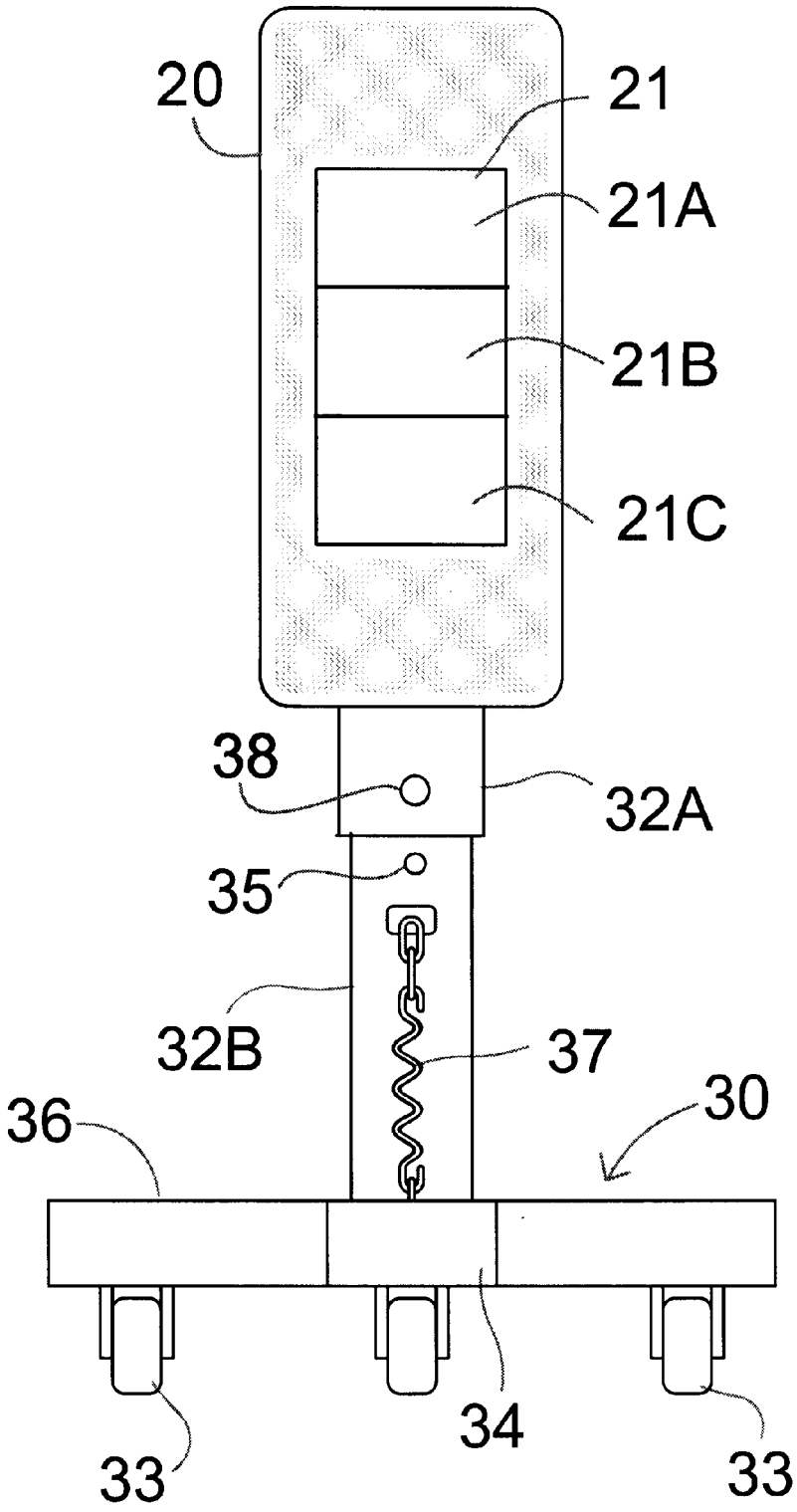
FIG. 2 is an end elevational view of the present invention showing the hitting tire mounted on the stand and indicating the hitting zone on the tire.
Figure 3:
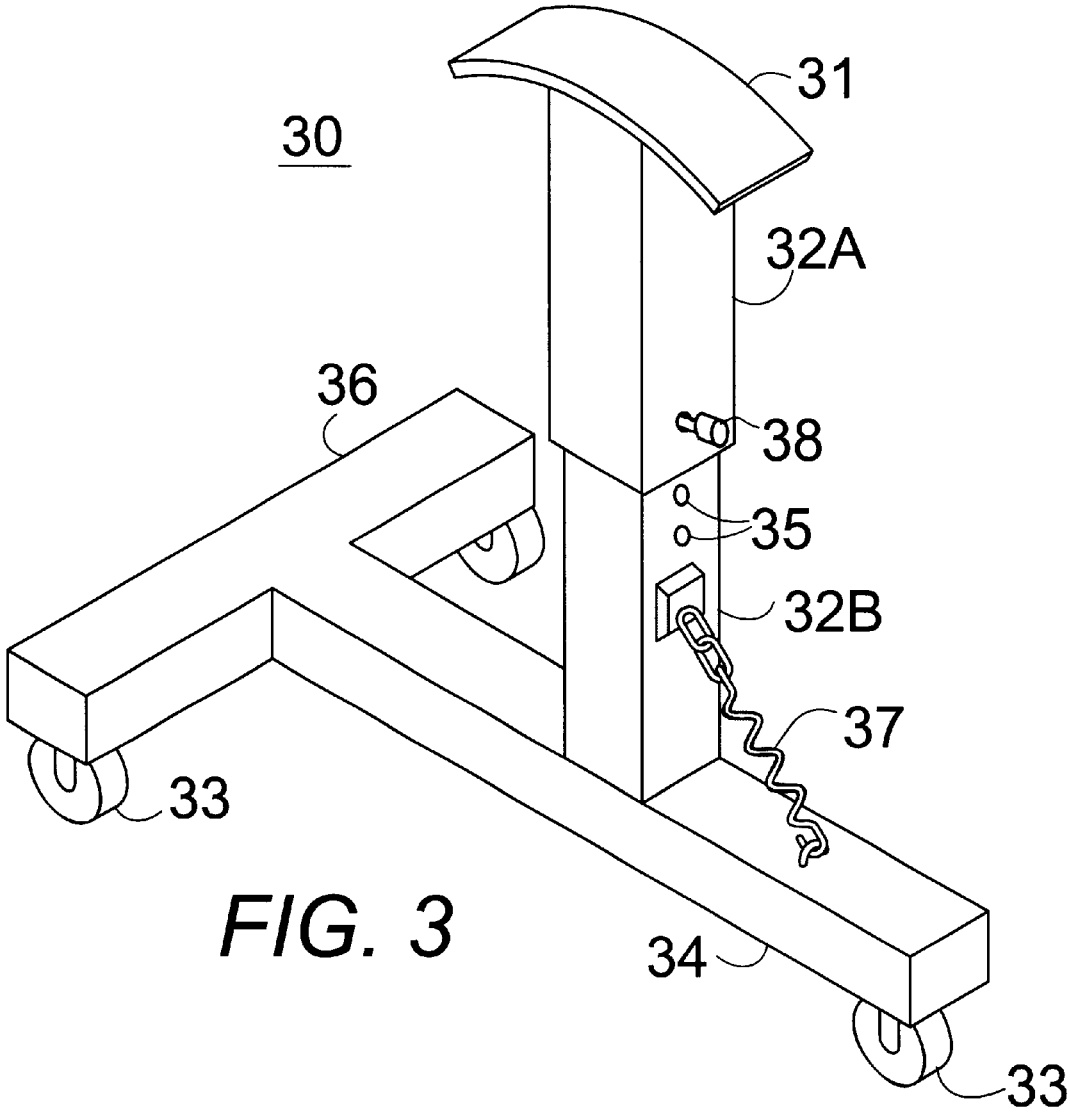
FIG. 3 is a perspective view of the stand of the invention with the tire removed to view the details of the stand.
Figure 4:
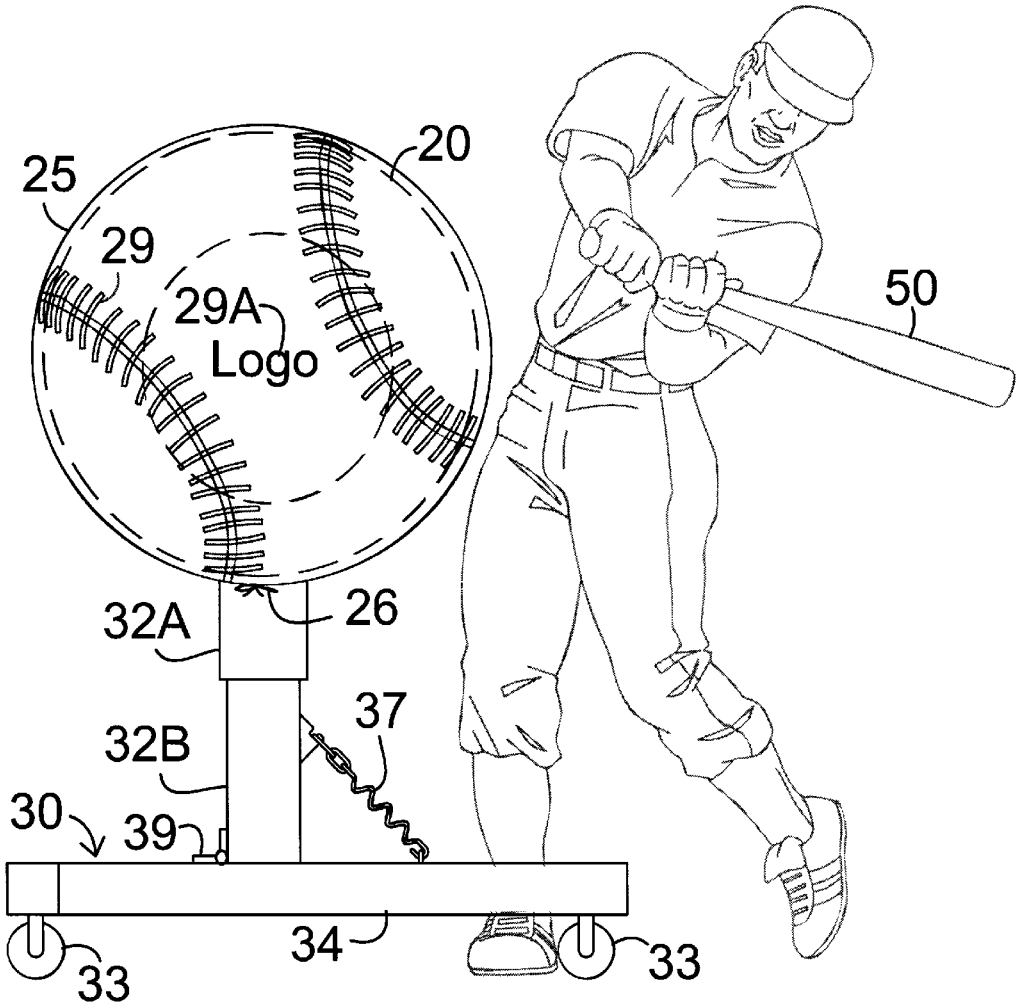
FIG. 4 is a side elevational view of the invention showing a covering over the tire mounted on the stand, the covering being imprinted to simulate the look of a baseball or having other imprinting including a logo and showing a batter in the process of hitting the covered tire portion of the invention.

The tire 20 is capable of being hit by a baseball bat 50 (as shown in FIG. 4) on a side tread portion 21 (as shown in FIG. 2) if the tire 20. The motion of the baseball bat 50 is resisted by anatural resilience of the tire 20 and the tension means 37 between the vertical post 32B and the forizntal support 36. Upon the vertical post 32B pivoting relative to the horizontal support 36 in response to the force of the baseball bat 50, the tension means 37 is capable of returning the vertical post 32B to a vertical position.

The device further comprises a covering 25 (as shown in FIG. 4) for the tire 20 formed from sheet material encompassing the tire 20 and secured to the tire 20 by a securing means 26. The securing means 26 comprises a means of tying the covering 25 around the tire 20. The sheet material covering 25 has external visual indicia 29 that simulate the appearance of a baseball. The sheet material covering further includes indicia 29A selected from the group including a logo, a team name, a player name, a tournament name, a product name and an advertisement.

In practice, the device would be rolled to a preferred practice location and then made stationary by engaging a locking means 33A on the wheels 33 of the horizontal base 36. The height of the device could then be adjusted to accommodate the hitter's needs by means of the telescoping fit of the vertical support 32A and the vertical post 32B. A hole 35 in the vertical support 32A would be matched up with the desired hole in the vertical post 32B; inserting a conventional locking pin 38 through the holes 35 would then lock the adjustment. The "leg" end 34 of the horizontal base 36 allows the hitter to assume a close stance, in relation to the device. The hitter would then be able to swing the bat 50 (as shown in FIG. 4), striking the tire 20 on its side repetitively, in the hitting zone 21 (depicted in FIG. 2) thereby gaining power and accuracy in their swing. The hitting zone 21 comprises of three areas 21A, 21B, and 21C that would further develop the hitter's accuracy.

It is understood that the preceding description is given merely by way of illustration and not in limitation of the invention and that various modifications may be made thereto without departing from the spirit of the invention as claimed.

What is claimed is:

1. A baseball hitting practice device for improving power as well as technique in hitting a baseball, the device comprising:

a stand having a horizontal support capable of being positioned on the ground and a vertical support having a vertical post attached to the horizontal support by a hinge means, the vertical support having a top arched portion;

an automotive tire having a natural resilience and a radius matching a radius of the arched portion of the vertical support, the tire being provided with an opening through a bottom tread portion of the tire capable of receiving the vertical support and vertical post therethrough so that the tire is capable of being rigidly installed on the vertical support in a vertical orientation of the tire with a top interior of the tire resting on the top arched portion of the vertical support and the vertical support and vertical post passing through the opening in the bottom tread portion of the tire so that the tire will not rotate;

a securing means for rigidly attaching the tire to the arched portion of the vertical support;

a tension means between the horizontal support and the vertical post to create a resistance to pivoting the vertical post relative to the horizontal support;

wherein the tire is capable of being hit by a baseball bat on a side tread portion of the tire so that the motion of the baseball bat is resisted by a natural resilience of the tire and the tension means between the vertical post and the horizontal support upon the vertical post pivoting relative to the horizontal support in response to the force of the baseball bat and the tension means is capable of returning the vertical post to a vertical position.

2. The device of claim 1 further comprising a covering for the tire formed of a sheet material encompassing the tire and secured to the tire by a securing means.

3. The device of claim 2 wherein the sheet material further comprises external visual indicia.

4. The device of claim 3 wherein the visual indicia simulates an appearance of a baseball.

5. The device of claim 3 wherein the visual indicia further comprises indicia selected from the group including a logo, a team name, a player name, a tournament name, a product name and an advertisement.

6. The device of claim 3 wherein the securing means comprises a means of tying the covering around the tire.

7. The device of claim 1 wherein the tension means comprises a spring means.

8. The device of claim 7 wherein the spring means comprises a spring and a cable.

9. The device of claim 8 wherein the tension means further comprises a turnbuckle on the cable for adjusting the tension of the spring.

10. The device of claim 1 wherein the horizontal support further comprises wheel means for moving the device.

11. The device of claim 10 wherein the wheeled means are provided with locking mechanisms for making the device stationary.

12. The device of claim 1 wherein the vertical support and the vertical post inter-fit to create a telescoping means thereby providing height adjustment capability.

13. The device of claim 12 wherein the telescoping means is provided with a locking means that preferable comprises of one hole in the vertical support, multiple holes in the vertical post, and a conventional locking pin.

14. The device of claim 1 wherein a three leveled strike zone is marked on the tire in preferably flourescent enamel paint.

15. The device of claim 1 wherein the vertical support and the top arched portion are rigidly connected, preferably by welding, to prevent rotation of the tire.

* * * * *